United States Patent [19]

Capponi

[11] Patent Number: 5,056,179

[45] Date of Patent: Oct. 15, 1991

[54] COSMETIC APPLICATOR WITH PLURAL APPLICATOR ELEMENTS

[75] Inventor: Joseph P. Capponi, Maspeth, N.Y.

[73] Assignee: Aversa & Martin, Inc., Brooklyn, N.Y.

[21] Appl. No.: 560,432

[22] Filed: Jul. 31, 1990

[51] Int. Cl.[5] ..... A47L 25/00

[52] U.S. Cl. ..... 15/105; 15/184; 132/218; 132/320; 401/29; 401/31; 401/34

[58] Field of Search ..... 15/105, 106, 52, 114, 15/184; 132/216, 218, 317, 318, 320; 401/29, 30, 31, 34

[56] References Cited

U.S. PATENT DOCUMENTS

| | | | |
|---|---|---|---|
| 2,392,840 | 1/1946 | De Groft | 15/184 |
| 2,582,451 | 1/1952 | Mureau | 15/184 |
| 2,591,537 | 4/1952 | Gordon | 15/184 |
| 2,607,942 | 8/1952 | Gordon | 15/184 |
| 2,631,321 | 3/1953 | Mureau | 15/184 |
| 2,657,411 | 11/1953 | Becker | 15/184 |
| 2,789,304 | 4/1957 | Leavin | 15/184 |
| 2,913,750 | 11/1959 | Aversa | 15/184 |
| 3,268,939 | 8/1966 | Aversa | 15/184 |
| 3,288,116 | 11/1966 | Poritz | 401/29 |
| 3,863,288 | 2/1975 | Aversa | 15/184 |

FOREIGN PATENT DOCUMENTS

| | | | |
|---|---|---|---|
| 1136611 | 9/1962 | Fed. Rep. of Germany | 401/34 |
| 1100032 | 9/1955 | France | 401/34 |

*Primary Examiner*—Harvey C. Hornsby
*Assistant Examiner*—Mark Spisich
*Attorney, Agent, or Firm*—Morrison Law Firm

[57] ABSTRACT

A cosmetic applicator embodies two cosmetic applicator elements in a single barrel housing. One applicator element is slidably extendable from retracted position in the housing to extended use position wherein it is extended axially a distance from an opening at one end of the housing. The other applicator element rotatably is axially extended from retracted position in the housing to use position. The operating means by which each element is extended are located in the housing in such manner that the operating means associated with the said other element lies nested in the operating means associated with the first applicator element when that element is retracted. Thus, the length of the housing can be shortened and still accommodate both operating means since they occupy a common length extend in the housing. One applicator element can be a lipbrush and the other an eyeliner.

14 Claims, 1 Drawing Sheet

FIG. 1
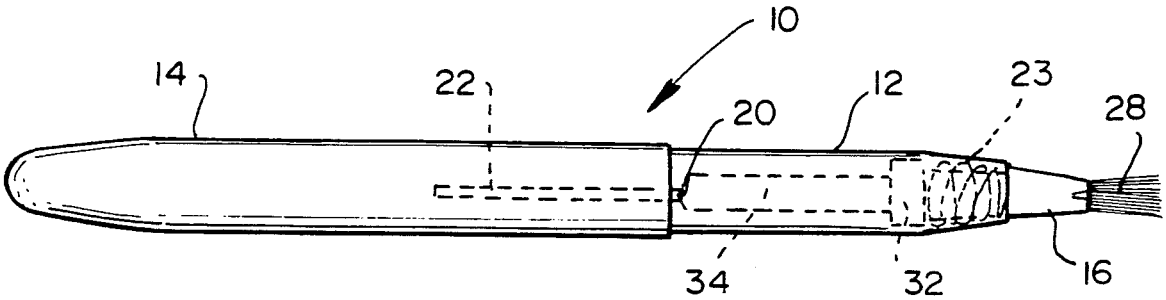
FIG. 2
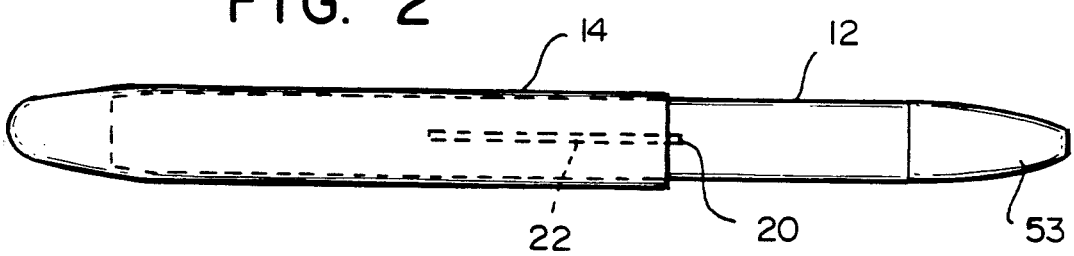
FIG. 3
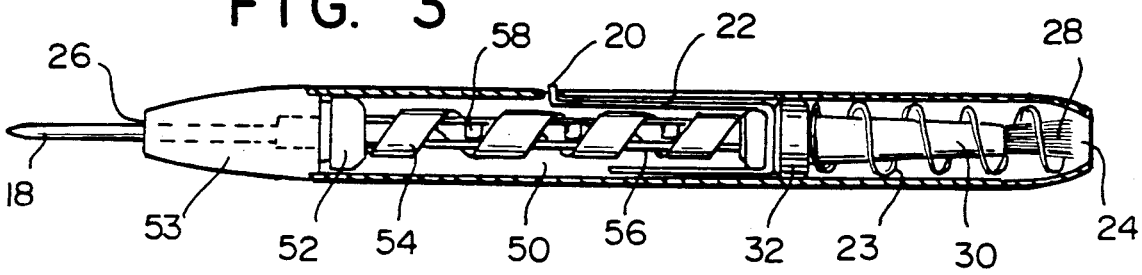
FIG. 4
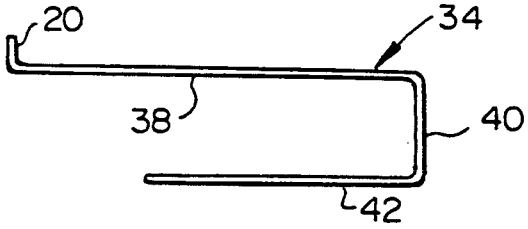
FIG. 6
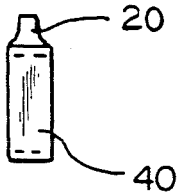
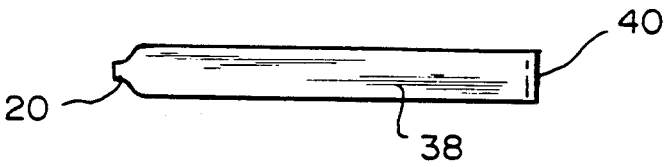
FIG. 5

COSMETIC APPLICATOR WITH PLURAL APPLICATOR ELEMENTS

BACKGROUND OF THE INVENTION

The present invention relates to a cosmetic applicator and, more particularly, to such an applicator as embodies plural applicator elements such as a lipbrush and an eyeliner in a compact yet fully functional plural use device readily storable in a user's purse or compact carrier.

Cosmetic devices of various description and use purpose are known, such devices including cosmetic elements such as lipbrushes with which a user can apply and outline lip cosmetic, and also eyeliners for use in shaping eye cosmetic. Such devices generally are provided as separate units so a user commonly has to carry each separate device in a purse, compact kit or like carrier. Embodiment of each type device in a single structure of convenient size heretofore has not been viewed as being an especially practical expedient because the operating mechanism to extend the respective cosmetic applicator elements from recessed locations in a holder such as a barrel to extended outwardly-from-the-barrel positions, was thought to involve barrel length requirement somewhat longer than acceptable to most users in terms of the size device the user preferred to carry in a purse or similar carrying enclosure.

Accordingly, it is desirable that a cosmetic applicator be provided which is of compact length size, but yet allows incorporation in a relatively short, conveniently handled housing of two distinct and separate purpose cosmetic applicator elements.

OBJECTS AND SUMMARY OF THE INVENTION

Accordingly, it is an object of the invention to provide a cosmetic applicator which overcomes the drawbacks of the prior art.

It is a further object of the invention to provide a cosmetic applicator which embodies two applicator elements such as a lipbrush and an eyeliner in a single barrel housing.

It is a still further object of the invention to provide a cosmetic applicator that is inexpensively, yet simply made while being especially suited for the dual use purpose intended and made so without requiring recourse to incorporation of other than the most effective and sure operating extension means for extending the applicator elements.

Briefly stated, there is provided a cosmetic applicator which embodies two separate use and purpose functioning cosmetic applicator elements in a single barrel housing. One applicator element is slidably extendable from retracted position in the housing to extended use position wherein it is extended axially a distance from an opening at one end of the housing. The other applicator element is axially extended from retraced position in the housing to use position by rotatably operated extension means. The operating means by which each element is extended are located in the housing in such manner that the operating means associated with the said other element lies nested in the operating means associated with the first applicator element when that last-mentioned element is retracted. Thus, the length of the housing can be shortened and still accommodate both operating means since they occupy a common length extent in the housing. One applicator element can be a lipbrush and the other an eyeliner.

In accordance with these and other objects of the invention, there is provided a cosmetic applicator which embodies plural cosmetic applicator elements in a single housing, the cosmetic applicator comprising an elongated tubular barrel having opposite open barrel ends, with there being a first cosmetic applicator element disposed in a normally retracted position in said barrel adjacent one of said open ends. Means are carried in the barrel and are operable to stoke said first applicator element outwardly of said barrel a distance through said one open end. A second cosmetic applicator element is disposed in a normally retracted position in said barrel adjacent the other one of said open ends, and means in the barrel are operable to stroke said second applicator element outwardly of said barrel a distance through said other open end, with the first-mentioned operating means extending at least a common longitudinal distance within said barrel with said first-mentioned operating means being nested about said second-mentioned operating means in non-interfering positional relationship therewith, said common longitudinal distance being substantially less than the sum of the distances said applicator elements can be stoked by their respective operating means whereby the length of the barrel occupied by both said operating means can be reduced while retaining normal applicator extension function.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 is a top plan view of a cosmetic applicator constructed in accordance with the principles of the present invention, one of the applicator elements, viz., a lipbrush being shown in its extended position, the lipbrush having been moved to such position by insertion of a cap member over the opposite end of the barrel to engage a projecting tab of an in barrel actuator that is used to slidably extend the lipbrush;

FIG. 2 is a top plan view of the cosmetic applicator shown in FIG. 1 but with the cap inserted over the end of the barrel through which the lipbrush extends but that lipbrush now being in retracted position and an eyeliner now extending from the said barrel opposite end, having been thus extended by operating a rotary extension means carried in the barrel and which rotary extension means lies nested in the operating means of the lipbrush;

FIG. 3 is a longitudinal sectional view of the barrel, partly in full lines, depicting the internal operating components housed therein, both applicator elements being shown retracted and the cap member having been removed; and FIGS. 4, 5 and 6 are respective top plan, side elevational and right end elevational views of the actuator member used for extending the lipbrush to use position.

DETAILED DESCRIPTION OF THE PREFERRED EMBODIMENT

Referring to FIG. 1, the cosmetic applicator 10 includes an elongated tubular barrel 12 and a cap member 14, there being carried in the barrel two separate purpose applicator elements, namely, a lipbrush 16 and an eyeliner 18, the lipbrush being depicted in its extender use position, and the eyeliner in its retracted non-use position.

The cap member 14 is shown in FIG. 1 inserted over one end of barrel 12 and engaged with a tab 20 rideable in an elongated barrel slot 22. Such engagement which holds the tab at one of two extremes of slot 22, maintains the lipbrush extended from the barrel in opposition to the biasing effect of coil spring 23 (FIG. 3) which normally urges the lipbrush to recessed-within-the-barrel retracted position. When the lipbrush is retracted, the tab 20 locates at the other of the elongated barrel slot extremes. The tab sliding movement in the barrel slot for extension and retraction movements of the lipbrush is the same as, e.g., that disclosed in the herein Assignee's earlier issued U.S. Pat. Nos. 3,268,939 and 3,863,288.

The barrel 12 has openings 24, 26 at the two opposite ends thereof, one opening 24 accommodating lipbrush extension, and the other opening, extension of the eyeliner. These openings are defined by the termini of inwardly fairing end sections of the otherwise hollow-cylindrically shaped barrel. In normal non-use configuration as illustrated in FIG. 2, cap member 14 is received over the end of the barrel having opening 24, since it is desirable to protect the brush element from undo exposure to air as this tends to dry the brush shortening its use life.

As noted earlier, the present cosmetic applicator incorporates two separate applicator element extension/retraction operating means in the barrel. This is done in such way as minimizes the axial length of the barrel interior inasmuch as one such operating means occupies a common barrel length expanse with the other. As a result, barrel length can be shortened to the advantage of rendering the cosmetic applicator more compact than where, for example, axial in-line operating means are used. Further elaboration on this as well as particularized description of the several components and elements housed in the barrel, and manner of operation of the same will be given next and with reference to FIG. 3.

Lipbrush 16 comprises a tufted hair bundle 28 held clenched in a shankpiece 30 which latter element includes a widened head 32 widthwise approximating the barrel inner diameter. Coil spring 23 encircles the shankpiece and tufted bundle when the lipbrush is retracted and is the instrument that normally maintains the lipbrush so recessed in the barrel. The coil spring is a compression spring anchored at one end against the head 32 and at its other end against the barrel faired-in structure at the right end of the barrel. The normal urging on the lipbrush is then one that keeps it retracted unless superior counterbias be applied thereto.

This counterbias can and is applied when the cap member is engaged with tab 20 to stroke the latter rightwardly from its FIG. 3 shown position in slot 22 to the other slot extreme. Tab 20 is one part (and the only part externally located with respect to the barrel) of an actuator 34 slidably movable in the barrel and positioned therein on the side of head 32 remote from the tufted bundle.

As seen with reference to FIGS. 4–6, the actuator 34 is a single-piece, spring steel, shaped component that includes in addition to the tab 20, a second part 38 integral with the tab and right angularly or orthogonally disposed therewith, the part 38 extending alongside of the barrel inner surface some distance axially toward the head 32 and terminating in joinder with third part 40 orthogonal to part 38 and disposing diametrically in the barrel in abutting contact with the left end face of head 32. The third part in turn is joined to axially extending fourth part 42 that disposes close to an opposite side inner surface of the barrel.

It will be seen that actuator parts 38, 40, 42 define an encircling expanse within the barrel when the lipbrush is retracted, which constitues a nest wherein the operating means 50 for extending and retracting the eyeliner is positioned. This common length coextensive run of the two operating means is a reason the barrel length can be shorter than usual for a device of this character.

It is understood that the actuator is bodily slid rightwardly in bearing contact with head 32 from the FIG. 3 position to extend the lipbrush and in that position it does not nest operating means 50, being axially spaced a distance from that means.

Operating means 50 is a type commonly used in writing instruments and certain cosmetic devices. Its operation involves employing rotary motion to axially advance an element, the rotary motion being applied with an element that remains axially fixed but in its rotation cooperating with a member that converts rotary motion to straightline advance. Representative of such devices is that depicted.

Means 50 includes rotatable ring 52 axially fixed but rotatable in end fitting 53 which constitutes a part of the inwardly faired section of the barrel. A plural pitch thread sleeve 54 is fixed to rotate with ring 52 and in turn centrally axially receives loosely, a carrier tube 56, this carrier tube being fitted with one or more radial cams 58. At a tip end of the carrier tube, a rod 18 of eyeline cosmetic is held by the carrier tube. When ring 52 and sleeve 54 rotate, the cams following the thread course of sleeve 54 converts the rotary motion of the sleeve to an axial movement of advance or retraction of the carrier tube depending on the direction of rotation. In such way the eyeliner rod 18 extends or retracts as required.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A cosmetic applicator embodying plural cosmetic applicator elements in a single housing, said cosmetic applicator comprising an elongated tubular barrel having opposite open barrel ends, a first cosmetic applicator element disposed in a normally retracted position in said barrel adjacent one of said open ends, means in said barrel operable to stroke said first applicator element outwardly of said barrel a distance through said one open end, a second cosmetic applicator element disposed in a normally retracted position in said barrel adjacent the other one of said open ends, and means in said barrel operable to stroke said second applicator element outwardly of said barrel a distance through said other open end, said first-mentioned operating means extending at least a common longitudinal distance within said barrel with said second-mentioned operating means and being nested about said second-mentioned operating means in non-interfering positional relationship therewith, said common longitudinal distance being substantially less than the sum of the distances said applicator elements can be stroked by their respective operating means whereby the length of the barrel occupied by both said operating means can be reduced while retaining normal applicator extension function.

2. The cosmetic applicator of claim 1 in which the first operating means is operable to slidably stroked said first cosmetic applicator element outwardly from its retracted to extended position.

3. The cosmetic applicator of claim 2 in which said first applicator element is normally biased to retracted position within said barrel by spring means.

4. The cosmetic applicator of claim 3 in which said first operating means includes an actuator member carried in the barrel abutting said first applicator element but operable from a location at the exterior of the barrel for applying sliding force to said first element to counter the bias of said spring means and therewith slide said first element to extended position.

5. The cosmetic applicator of claim 4 in which the actuator member is a shaped, one-piece element comprised of a plurality of joined parts, said parts including a tab locating in an elongated slot in the barrel extending radially of the barrel, a second part orthogonal to the tab and axially directed in the barrel close to an inner surface of the latter, a third part transversely extending in the barrel and joined with an axially directed fourth part spaced close to an opposite side inner surface of the barrel, the second, third and fourth parts defining an actuator second operating means encirclement path about said second operating means when the first applicator element is retracted, said second, third and fourth parts displacing axially from the encirclement path when the first applicator element is extended.

6. The cosmetic applicator of claim 5 in which the barrel elongated slot has two extreme ends, said tab locating at one extreme when the first applicator element is in retracted position and the other extreme when the first applicator element is extended.

7. The cosmetic applicator of claim 6 further comprising an elongated cap member receivable on the barrel, said cap member having at least on open end insertable over the barrel so that an edge structure of the cap member defining the open end thereof can engage said tab to slide the tab between said one and said other of said two barrel longitudinal slot extremes.

8. The cosmetic applicator of claim 7 in which said second operating means is rotatably operable to axially advance said second cosmetic applicator from retracted to extended position.

9. The cosmetic applicator of claim 8 in which said second operating means is an advance screw carried in the barrel for rotation at a fixed location, said second applicator element including a sleeve engaged with said advance screw and axially moved by rotation of said screw member.

10. The cosmetic applicator of claim 2 in which said second operating means is operable to rotatably axially advance said second cosmetic applicator from retracted to extended position.

11. The cosmetic applicator of claim 10 in which the first applicator element comprises a lipbrush.

12. The cosmetic applicator of claim 11 in which the lipbrush includes a brush carried in a shankpiece, the shankpiece having an enlarged end flange, the end flange being engaged by a slidable actuator operable from exteriorly of the barrel to extend the lipbrush.

13. The cosmetic applicator of claim 11 in which the second applicator element comprises an eyeliner.

14. The cosmetic applicator of claim 13 in which said second operating means comprises rotatable means operable to extend said eyeliner axially to extended position on rotation of said means.

* * * * *